US009766047B2

(12) United States Patent
Harmon et al.

(10) Patent No.: US 9,766,047 B2
(45) Date of Patent: Sep. 19, 2017

(54) ARMORED CAB FOR LIGHT TACTICAL VEHICLES

(71) Applicant: BAE Systems Tactical Vehicle Systems LP, Sealy, TX (US)

(72) Inventors: Matthew R. Harmon, Hamilton, OH (US); Thomas Matthew Berning, Mainville, OH (US); Sean Emmett Carey, Livonia, MI (US); Suresh Devu, West Chester, OH (US); Kevin M. Klatte, Milford, OH (US); Mark R. Lappin, Cincinnati, OH (US); Michael D. Reynolds, Jr., Cincinnati, OH (US); Rabih E. Tannous, Sterling, MI (US); Robert J. Wittman, Dayton, OH (US)

(73) Assignee: BAE Systems Tactical Vehicle Systems LP, Sealy, TX (US)

( * ) Notice: Subject to any disclaimer, the term of this patent is extended or adjusted under 35 U.S.C. 154(b) by 0 days.

(21) Appl. No.: 14/886,746

(22) Filed: Oct. 19, 2015

(65) Prior Publication Data

US 2016/0131458 A1 May 12, 2016

Related U.S. Application Data

(62) Division of application No. 13/679,140, filed on Nov. 16, 2012, now Pat. No. 9,163,910.

(Continued)

(51) Int. Cl.
*F41H 7/04* (2006.01)
*F41H 5/013* (2006.01)

(52) U.S. Cl.
CPC ..... *F41H 7/044* (2013.01); *F41H 7/042* (2013.01)

(58) Field of Classification Search
CPC . F41H 7/042; F41H 7/044; F41H 7/04; F41H 5/013

(Continued)

(56) References Cited

U.S. PATENT DOCUMENTS 1,002,169 A 8/1911 McSweeney
1,149,127 A 8/1915 Giem (Continued)

FOREIGN PATENT DOCUMENTS

FR 2966231 A1 * 4/2012 ..... F41H 7/042
WO 0239048 5/2002

(Continued)

OTHER PUBLICATIONS

PCT International Search Report for PCT/US2008/083798.

(Continued)

*Primary Examiner* — H Gutman
(74) *Attorney, Agent, or Firm* — Wood Herron & Evans LLP

(57) ABSTRACT

An armored cab comprises a top wall, two side walls, a front wall, a back wall, and a bottom wall, the cab having a longitudinal axis. The bottom wall comprises a generally centrally disposed downwardly facing smooth concave wall portion extending substantially an entire length of the cab and generally parallel to the longitudinal axis of the cab and forming a power train tunnel of the cab, and a pair of opposite laterally disposed wall portions extending substantially the entire length of the cab and generally parallel to the longitudinal axis of the cab, each of the opposite laterally disposed wall portions extending downwardly and laterally inwardly and terminating in a lowermost portion of the bottom wall on either lateral side of the concave wall portion. The concave wall portion and the opposite laterally disposed wall portions are configured so as to present a (Continued)

substantially reduced surface area of the lowermost portions of the bottom wall in a downwardly facing direction. The armored cab includes various additional features that improve occupant survivability.

13 Claims, 15 Drawing Sheets

Related U.S. Application Data

(60) Provisional application No. 61/562,490, filed on Nov. 22, 2011.

(58) Field of Classification Search
USPC ..... 89/36.02, 36.08, 36.09; 296/187.07
See application file for complete search history.

(56) References Cited

U.S. PATENT DOCUMENTS

| | | | |
|---|---|---|---|
| 2,662,793 | A | 12/1953 | Lindsay |
| 4,215,645 | A | 8/1980 | Moeller |
| 4,492,282 | A | 1/1985 | Appelblatt et al. |
| 4,572,571 | A | 2/1986 | Malen |
| 5,533,781 | A | 7/1996 | Williams |
| 5,663,520 | A | 9/1997 | Ladika et al. |
| 6,363,830 | B1 | 4/2002 | Gonzalez |
| 6,658,984 | B2 | 12/2003 | Zonak |
| 6,805,401 | B2 | 10/2004 | Hayashi et al. |
| 6,834,912 | B2 | 12/2004 | Cardimen et al. |
| 6,840,570 | B2 | 1/2005 | Bock et al. |
| 7,195,306 | B2 | 3/2007 | Egawa et al. |
| 7,770,506 | B2 | 8/2010 | Johnson et al. |
| 7,836,810 | B2 | 11/2010 | Meyer |
| 7,883,135 | B2 * | 2/2011 | Ravid ..... B60N 2/4242 280/751 |
| 8,096,225 | B1 * | 1/2012 | Johnson ..... F41H 7/042 89/36.02 |
| 9,222,260 | B1 * | 12/2015 | Hao ..... E04C 2/32 |
| 2002/0145308 | A1 | 10/2002 | Honlinger |
| 2003/0010189 | A1 | 1/2003 | Zonak |
| 2007/0084337 | A1 | 4/2007 | Strassgurtl et al. |
| 2009/0058142 | A1 | 3/2009 | Park |
| 2009/0120274 | A1 | 5/2009 | Schneider et al. |
| 2010/0011948 | A1 | 1/2010 | Johnson et al. |
| 2011/0168001 | A1 | 7/2011 | Lee |
| 2011/0314999 | A1 | 12/2011 | Luther et al. |
| 2014/0310938 | A1 * | 10/2014 | Parida ..... F41H 5/04 29/428 |

FOREIGN PATENT DOCUMENTS

| | | |
|---|---|---|
| WO | 2004053421 | 12/2003 |
| WO | 2006085926 | 8/2006 |
| WO | 2009102364 | 8/2009 |
| WO | 2010090661 | 8/2010 |

OTHER PUBLICATIONS

Invitation to Pay Additional Fees and Communication Relating to the Results of the Partial International Search for corresponding PCT/US2012/065589, dated Aug. 23, 2013.

International Search Report and Written Opinion for corresponding PCT/US2012/065589, Dec. 2, 2013.

* cited by examiner

ARMORED CAB FOR LIGHT TACTICAL VEHICLES

RELATED APPLICATIONS

This application is a divisional of U.S. patent application Ser. No. 13/679,140 filed Nov. 16, 2012, which claims the priority benefit of U.S. Provisional Patent Application No. 61/562,490 filed Nov. 22, 2011, all of which are hereby incorporated by reference herein as if fully set forth in their entirety.

FIELD OF THE INVENTION

This invention relates generally to armored vehicles, and more particularly to an armored cab for light tactical vehicles.

BACKGROUND OF THE INVENTION

It is often desirable to transport troops, non-military personnel, and equipment across hostile territory via motorized land vehicles such as tactical vehicles, tactical trucks, and similar vehicles. Such vehicles may sustain land mine strikes, or attacks from improvised explosive devices ("IED's"), such as roadside bombs. During transport, people occupying the passenger cabin or cab of the vehicle are susceptible to injury from land mines, IED's, and other bombs and explosives. To withstand the forces of the foregoing types of attacks and explosions and to enhance the survivability of the occupants of the vehicle, it is known to armor the cab of the vehicle with armor plating.

The "light tactical vehicle" category of military vehicles is typically used to describe a tactical vehicle that weighs on the order of around 26,000 pounds or less. Examples of light tactical vehicles are the Joint Light Tactical Vehicle ("JLTV") and the High Mobility Multipurpose Wheeled Vehicle Modernized Expanded Capacity Vehicle ("HMMWV MECV"). For this weight category of military vehicle, one of the primary causes of injury to the vehicle occupants, particularly to the feet and legs of the occupants, is excessive upward floor velocity caused by an IED exploding beneath the vehicle and violently moving the vehicle upwardly. For example, an IED of the type encountered on today's battle field can generate an upward floor velocity of greater than 30 meters/second in a light tactical vehicle. Thus, even if the bottom of the vehicle is sufficiently armored such that the blast does not compromise the bottom of the vehicle, the vehicle occupants can still be injured due to the displacement and resulting velocity and acceleration of the floor.

A prior solution to armoring the bottom of a light tactical vehicle such as the JLTV is disclosed in the assignee's U.S. Pat. No. 8,096,225 ("'225 patent") issued Jan. 17, 2012 and hereby incorporated by reference herein as if fully set forth in its entirety. In the '225 patent, the bottom wall of the vehicle comprises a generally centrally disposed downwardly facing smooth concave wall portion that forms a power train tunnel of the cab, and a pair of opposite laterally disposed wall portions each of which extends downwardly and laterally inwardly and terminates in a lowermost portion of the bottom wall on either lateral side of the concave wall portion. The concave wall portion and opposite laterally disposed wall portions are configured to present a substantially reduced surface area of the lowermost portions of the bottom wall in a downwardly facing direction.

It is desirable to improve upon the armored cab of the '225 patent. It is also desirable to provide an armored cab for a light tactical vehicle, whether it be the JLTV, the HMMWV MECV, or other light tactical vehicle, that is not only armored but that also includes features or mechanisms that reduce upward floor velocity caused by an IED exploding beneath the vehicle.

SUMMARY OF THE INVENTION

One basic armored cab in which the various aspects of the present invention can be embodied comprises a top wall, two side walls, a front wall, a back wall, and a bottom wall, the cab having a longitudinal axis. The bottom wall comprises a generally centrally disposed downwardly facing smooth concave wall portion extending substantially an entire length of the cab and generally parallel to the longitudinal axis of the cab and forming a power train tunnel of the cab, and a pair of opposite laterally disposed wall portions extending substantially the entire length of the cab and generally parallel to the longitudinal axis of the cab, each of the opposite laterally disposed wall portions extending downwardly and laterally inwardly and terminating in a lowermost portion of the bottom wall on either lateral side of the concave wall portion. The concave wall portion and the opposite laterally disposed wall portions are configured so as to present a substantially reduced surface area of the lowermost portions of the bottom wall in a downwardly facing direction.

In one aspect, the armored cab further comprises a bridging structure positioned between forward and rearward ends of the concave wall portion and interconnecting opposite sides of the concave wall portion. The bridging structure can be oriented generally transverse to the longitudinal axis of said cab and can have a generally V-shaped cross-section when viewed in longitudinal vertical cross-section. The bridging structure can have a smooth convex upper edge that mates with the smooth concave wall portion continuously along a length of the smooth convex upper edge. The bridging structure can have a generally horizontal transverse lower edge.

In another aspect, the armored cab further comprises a generally horizontal floor on each lateral side of the concave wall portion, and an undulating reinforcement plate beneath each floor including undulations in and out of a horizontal plane of the undulating reinforcement plate. The undulating reinforcement plate can include two undulations below the horizontal plane of the undulating reinforcement plate spaced along a length of the undulating reinforcement plate. One undulation can correspond to a front seat occupant location and the other undulation can correspond to a back seat occupant location. Each floor can include a plurality of reinforcement beams on an underside of the floor and spaced along a length of the floor, and each reinforcement beam can be oriented generally transverse to the longitudinal axis of the cab and can be generally V-shaped when viewed in longitudinal vertical cross-section.

In another aspect, the armored cab further comprises a generally horizontal floor on each lateral side of the concave wall portion, each generally horizontal floor connected to a respective one of the side walls of the cab, and crushable connection structure connecting each side wall of the cab to a respective one of the pair of opposite laterally disposed wall portions of the bottom wall, each crushable connection structure located below a respective floor, each crushable connection structure configured to plastically deform in response to a blast to thereby reduce the amount of upward movement transferred from the opposite laterally disposed wall portions of the bottom wall to the cab side walls and from the cab side walls to the floors. Each connection structure can comprise a pair of plates, one of the pair of plates connected to an inner surface of a respective one of the cab walls at an upper end of the one plate, the other of the pair of plates connected to an outer surface of the respective one of the cab side walls at an upper end of the other plate, the pair of plates connected at lower ends of the plates to a respective one of the pair of opposite laterally disposed wall portions of the bottom wall. The material, height dimension, and thickness dimension of the pair of plates can be selected so as to produce the desired plastic deformation for a given blast load.

In another aspect, the armored cab further comprises a generally horizontal floor on each lateral side of the concave wall portion, and an isolation floor on each generally horizontal floor, each isolation floor configured to plastically deform in response to a blast to thereby reduce the amount of upward movement transferred from the generally horizontal floor to an occupant atop the isolation floor. Each isolation floor can further comprise a pair of deck supports, and a generally rectangular deck having a pair of opposite sides, each of the pair of deck supports supporting a respective one of the sides of the deck, each deck support comprising a channel section having a center section and opposite end sections, one of the end sections supported on the generally horizontal floor the other of the end sections supporting the deck, the center section having a longitudinally extending bend line such that the center section is generally V-shaped. Each of the channel sections can face inwardly. The material, height dimension of the center section, included angle of the V-shaped center section, and thickness dimension of the channel section can be selected so as to produce the desired plastic deformation for a given blast load.

The armored cab can be further configured as follows: Each of the pair of opposite laterally disposed wall portions of the bottom wall can be planar. The concave wall portion of the bottom wall can be a portion of a cylinder. The longitudinal axis of the cylinder can lie substantially in a common vertical plane with the longitudinal axis of the cab, and can be angled relative to a horizontal plane containing the longitudinal axis of the cab. The cylinder can be inclined such that an upper edge of the forward end is positioned above an upper edge of the rearward end. The radius of the cylinder can be swung from a center point located above a lowermost edge of the cab.

In another aspect, a readily replaceable isolation floor module is provided for installation into an armored cab, the isolation floor module configured to plastically deform in response to a blast to thereby reduce the upward movement transferred from the cab to an occupant atop the floor module. The floor module comprises a lower frame, a pair of deck supports, an upper deck, each deck support comprising a channel section having a center section and opposite end sections, one of the end sections of each deck support mounted to the frame and the other of the end sections of each deck support having the deck mounted thereto, and a plurality of energy absorbing columns spaced along each deck support and positioned between the opposite end sections of each deck support.

The center section can have a longitudinally extending bend line such that the center section is generally V-shaped. Each of the channel sections can face inwardly. The channel sections can be fabricated of aluminum. The energy absorbing columns can be pre-crushed aluminum foil honeycomb block, foam cylinders, or visco-elastic polymeric material. The material and geometry of the deck supports and the material and geometry of the energy absorbing columns can be selected so as to produce the desired plastic deformation for the given blast load. For example, the deck supports and the energy absorbing columns can be configured to plastically deform when a load of about 650 lbs is applied to the upper deck. The lower frame and the upper deck can both be generally rectangular. The lower frame can include a pair of longer longitudinally oriented side frame members, a pair of shorter transversely oriented end frame members, and a transversely oriented cross frame member.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
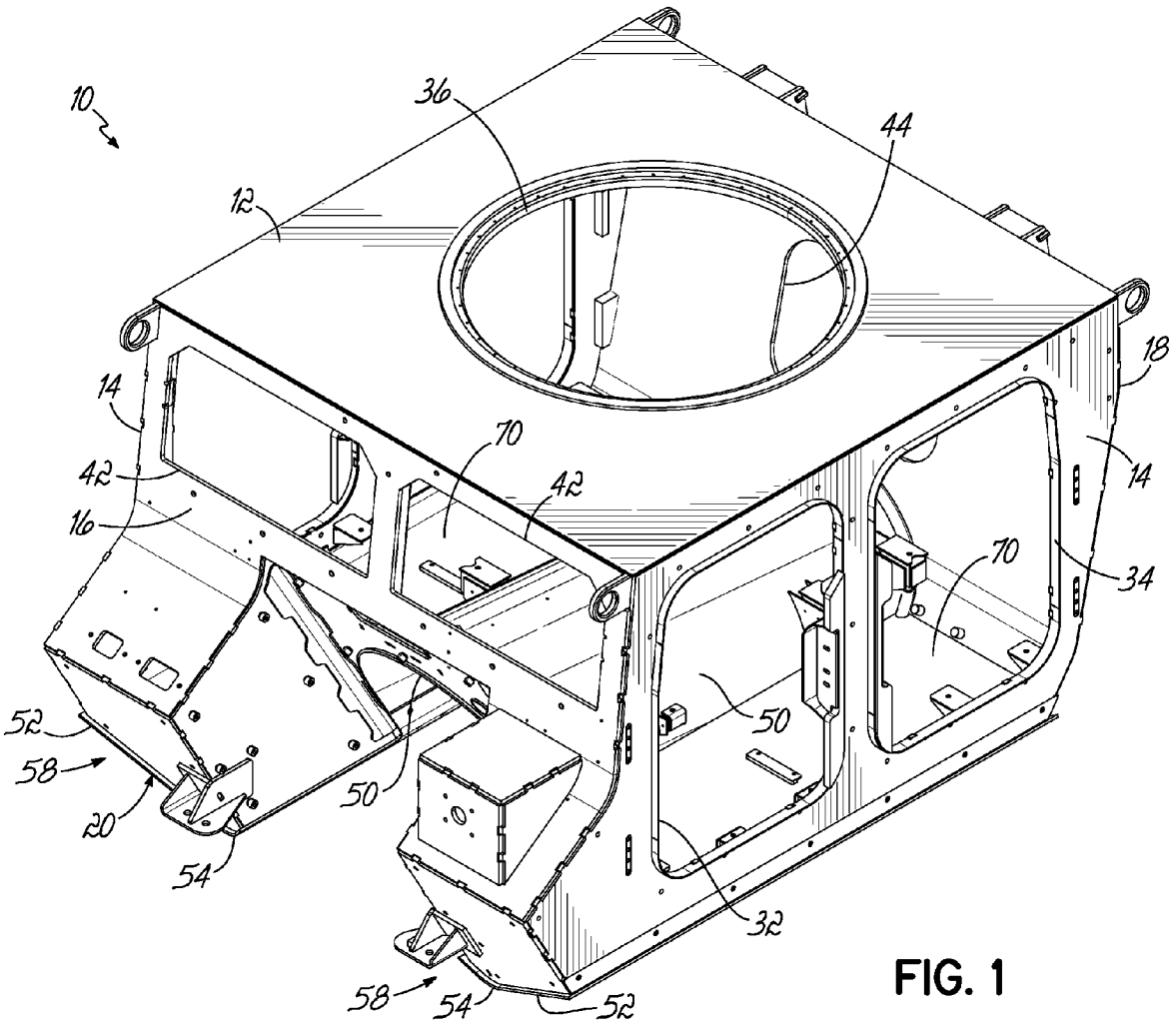
FIG. 1 is a top perspective view of a HMMWV MECV armored cab embodying aspects of the present invention.

Referring to FIG. 1, an exemplary cab 10 embodying principles of the present invention is illustrated. The cab 10 has a top wall 12, side walls 14, 14, a front wall or walls 16, a back wall or walls 18, and a bottom wall 20. As illustrated, cab 10 is for the HMMWV MECV series of vehicles, although the various inventive aspects embodied in cab 10 can be used for other light tactical vehicles such as the JLTV, or other tactical vehicles in general. The side walls 14, 14 can each include one or more door openings 32, 34 for suitable armored doors, and top wall 12 can include a gun turret opening 36 for a suitable gun turret. Front wall or walls 16 can include one or more window openings 42, 42 for suitable transparent armored glass or other transparent armored material. Back wall or walls 18 can include a window or door opening 44 for suitable transparent armored glass or other transparent armored material or a suitable armored door. The cab walls can be made of any high strength and high ductility material such as armored steel, high hard steel, Advanced High Strength Steel ("AHSS") or other suitable material whether metallic or non-metallic. The various components of the cab 10 can be joined by bolting, welding, etc.

Figure 2:
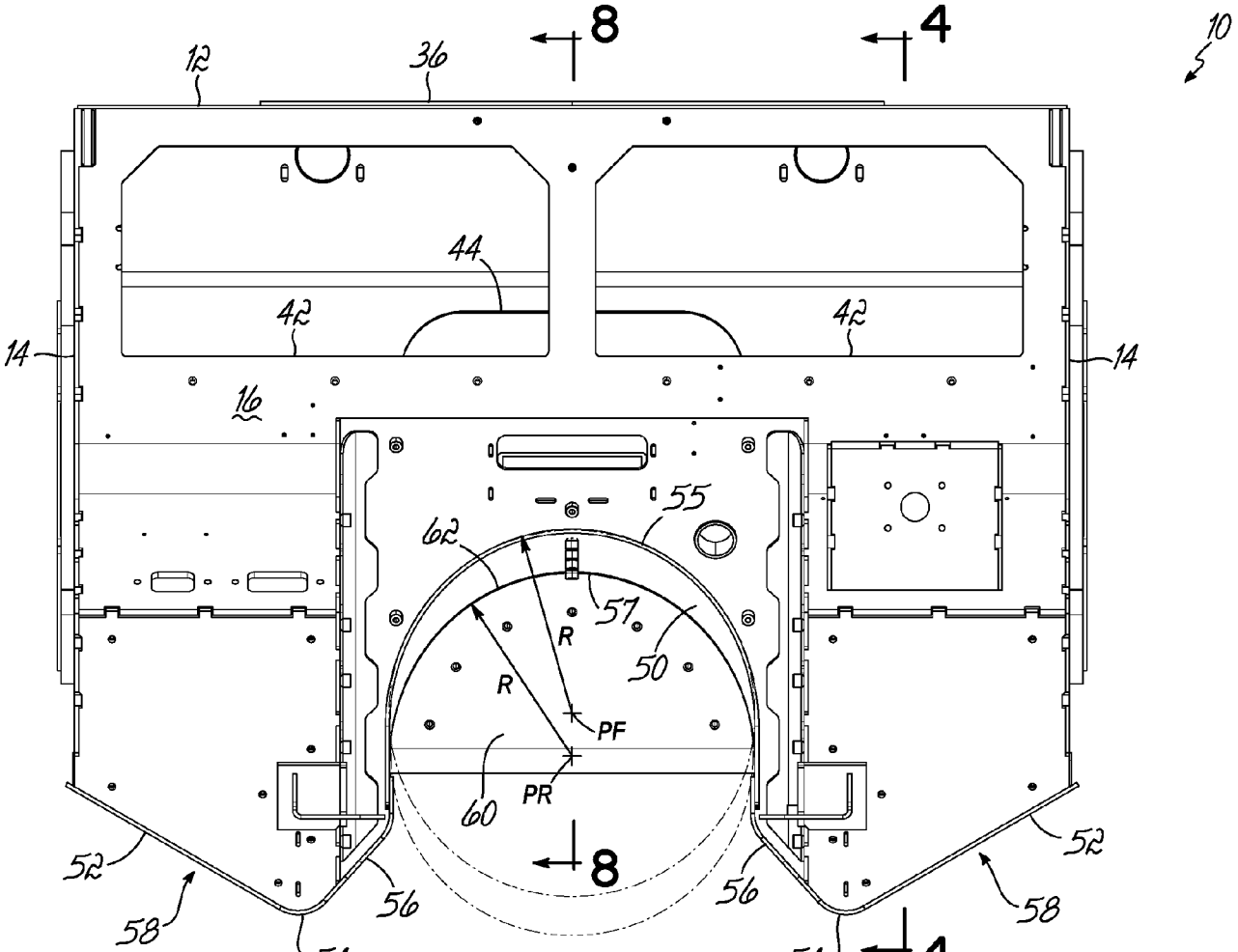
FIG. 2 is a front view of the cab of FIG. 1.
Figure 3:
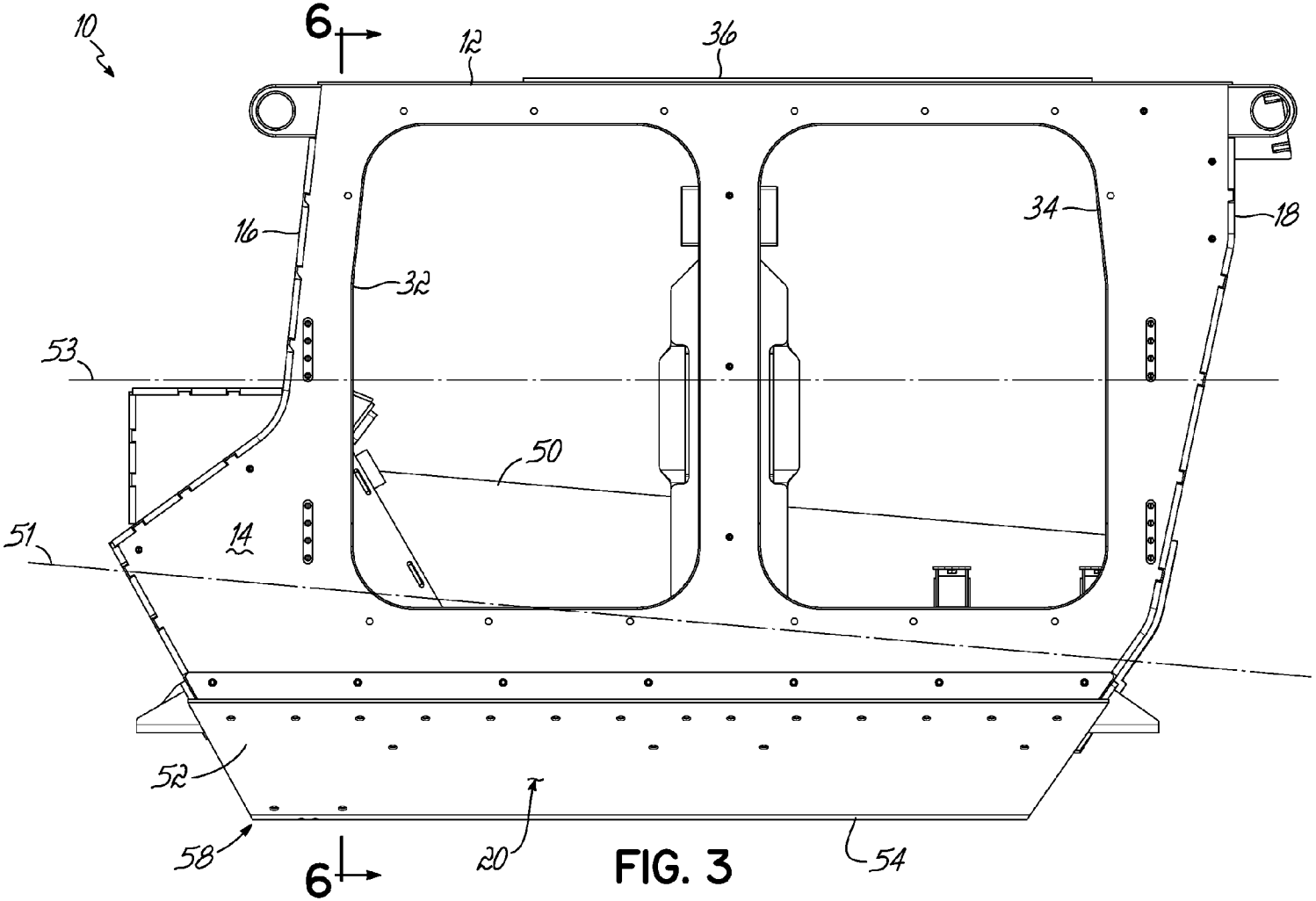
FIG. 3 is a side view of the cab of FIG. 1.

Referring to FIGS. 1-3, bottom wall 20 comprises a generally centrally disposed downwardly facing smooth concave wall portion 50 and a pair of opposite laterally disposed wall portions 52, 52. Concave wall portion 50 extends substantially an entire length of the cab 10 and generally parallel to the longitudinal axis of the cab 10 and forms a power train tunnel of the cab 10. The pair of opposite laterally disposed wall portions 52, 52 also extend substantially the entire length of the cab 10 and generally parallel to the longitudinal axis of the cab 10. Each of the opposite laterally disposed wall portions 52, 52 extends downwardly and laterally inwardly and terminates in a lowermost portion 54 of the bottom wall 20 on either lateral side of the concave wall portion 50. The concave wall portion 50 and the opposite laterally disposed wall portions 52, 52 are configured so as to present a substantially reduced surface area of the lowermost portions 54, 54 of the bottom wall 20 in a downwardly facing direction. The bottom wall 20 can further include a pair of opposite laterally disposed wall portions 56, 56 that also extend substantially the entire length of the cab 10 and generally parallel to the longitudinal axis of the cab 10. Each of the opposite laterally disposed walls portions 56, 56 can extend upwardly or upwardly and laterally inwardly toward concave wall portion 50. Thus, wall portion 52, lowermost portion 54, and wall portion 56 form a generally V-shaped structure 58 on either lateral side of the concave wall portion 50.

Concave wall portion 50 can be any smoothly arched shape, examples of which include cylindrical, frustoconical, ellipsoid, paraboloid, egg-shaped, and the like. In the illustrated exemplary embodiment, the concave wall portion 50 comprises a downwardly facing portion of a cylinder. The cylinder portion has a longitudinal axis 51 that lies substantially in a common vertical plane with the longitudinal axis 53 of the cab 10 and that is angled slightly relative to a horizontal plane containing the longitudinal axis 53 of the cab 10. For example, the cylinder portion can be inclined such that an upper edge of the forward end 55 of the cylinder portion is positioned above an upper edge of the rearward end 57 of the cylinder portion. The cylinder portion has a radius R which, at the forward end 55 of the cylinder portion and at the rearward end 57 of the cylinder portion, is swung from a point PF and PR, respectively, located above a lowermost edge of the cab 10. Additional details of concave wall portion 50 can be seen with reference to the assignee's '225 patent which is hereby incorporated by reference herein as if fully set forth in its entirety.

Figure 8:
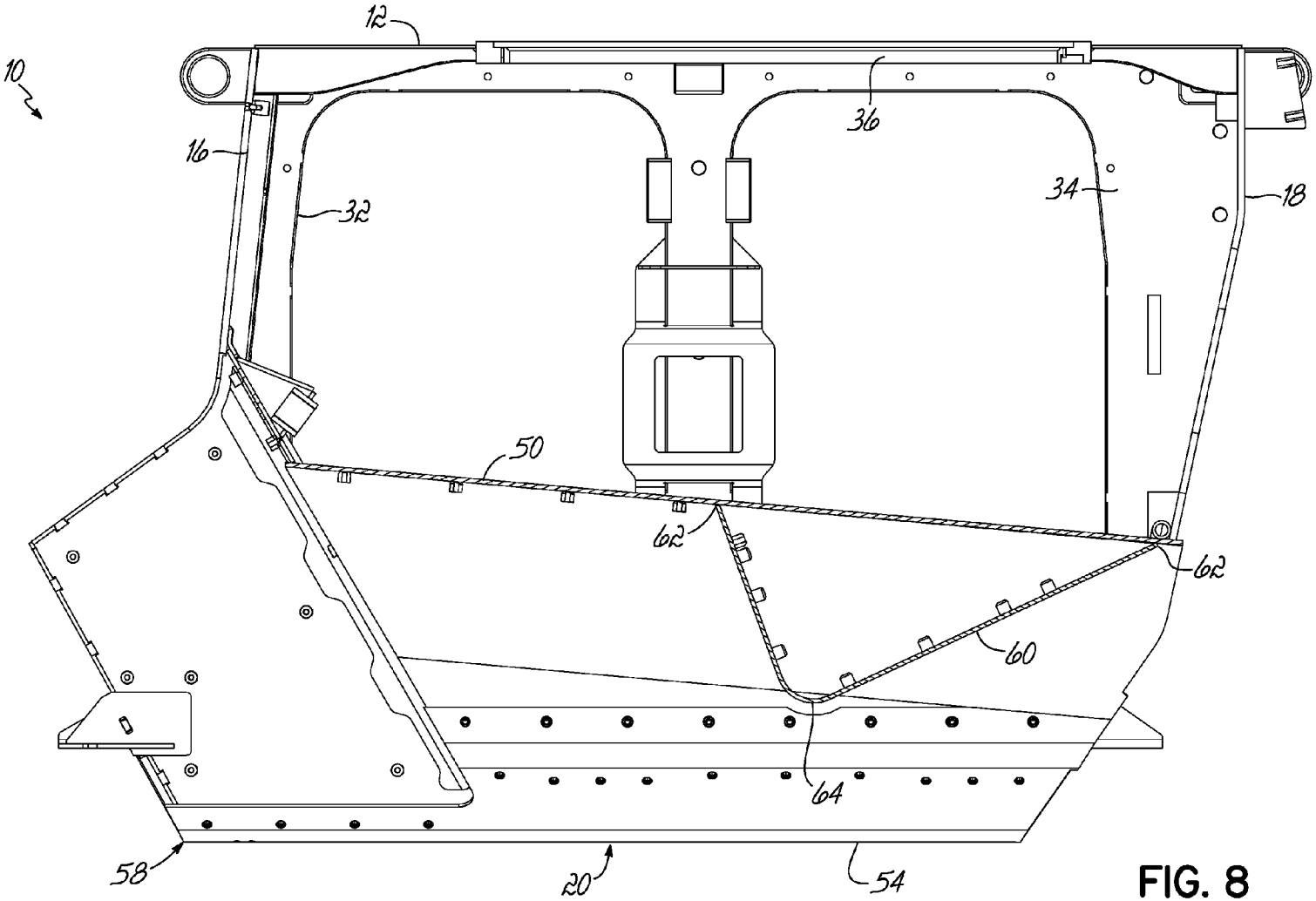
FIG. 8 is a cross-sectional view taken along line 8-8 in FIG. 2.

Referring to FIGS. 2 and 8, the armored cab 10 further comprises a bridging structure 60 positioned between forward and rearward ends of the concave wall portion 50 and interconnecting opposite sides of the concave wall portion 50. The bridging structure 60 can be oriented generally transverse to the longitudinal axis of said cab 10 and can have a generally V-shaped cross-section when viewed in longitudinal vertical cross-section. The bridging structure 60 can have a smooth convex upper edge 62 (or edges 62, 62) that mates with the smooth concave wall portion 50 continuously along a length of the smooth convex upper edge 62. The bridging structure 60 can have a generally horizontal transverse lower edge 64. By interconnecting the opposite sides of the concave wall portion 50 with bridging structure 60, the bending stiffness of the cab 10 about the longitudinal axis of the cab 10 is increased. Thus, when the cab 10 is subjected to an IED blast, the tendency of the V-shaped structures 58 on either lateral side of the cab 10 to displace away from one another and to displace upwardly is reduced. Consequently, this reduces upward displacement and resulting upward velocity and upward acceleration of the floors on either lateral side of the cab 10 thus reducing upward displacement and resulting upward velocity and upward acceleration on the occupants of the cab 10 whose feet are supported on those floors.

Figure 4:
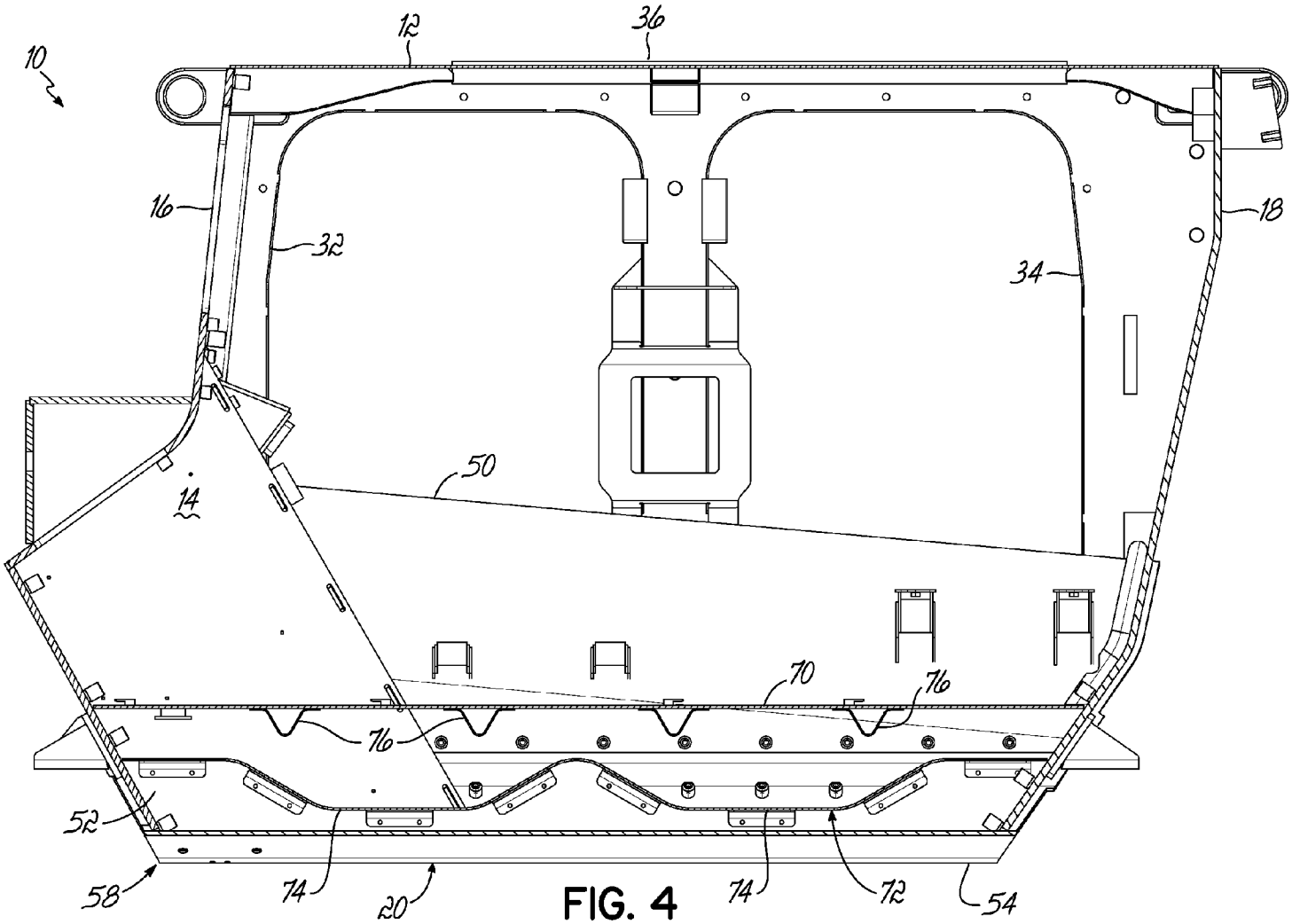
FIG. 4 is a cross-sectional view taken along line 4-4 in FIG. 2.
Figure 5:
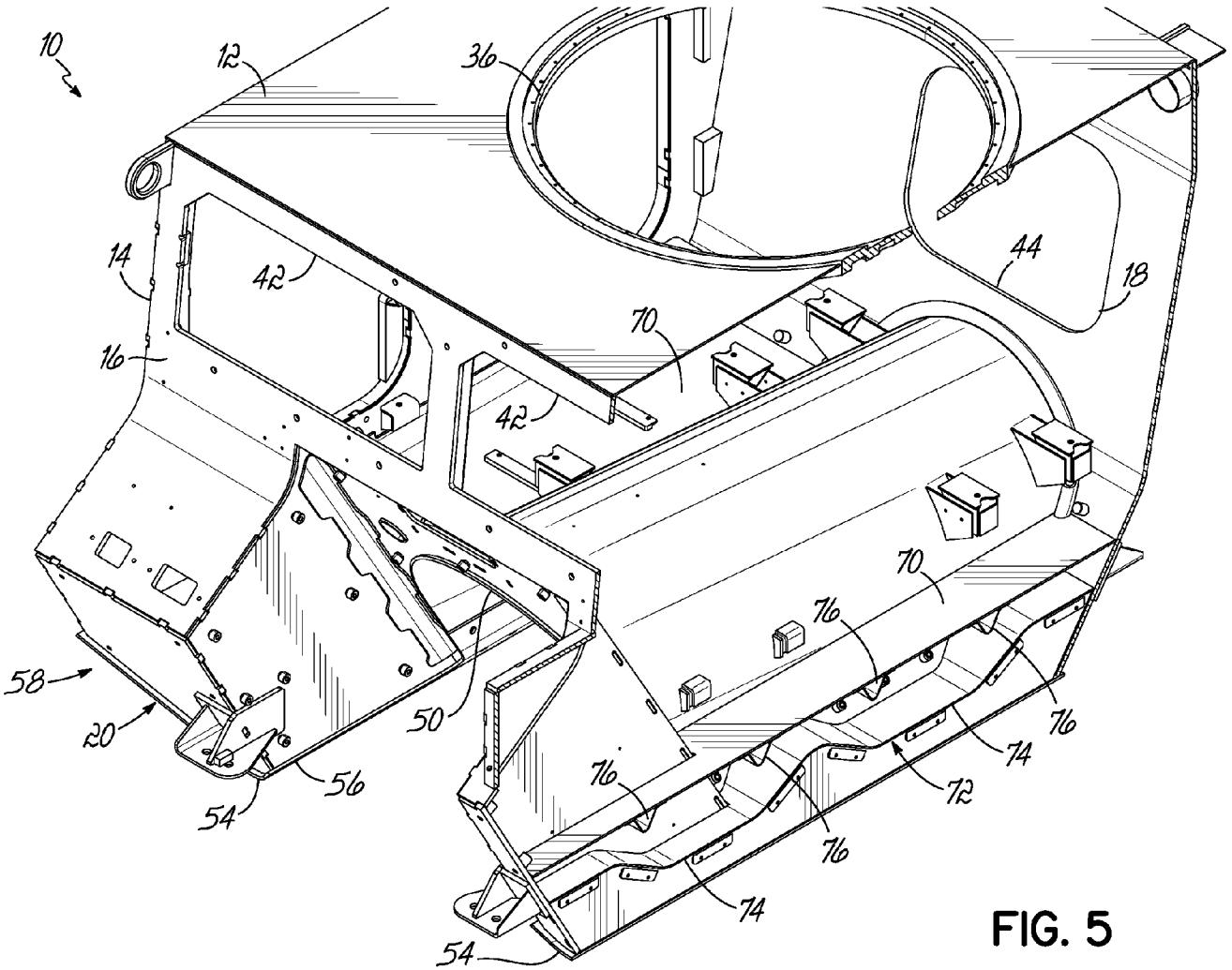
FIG. 5 is a view similar to FIG. 4 but with the cab shown in perspective.

Referring to FIGS. 4 and 5, the armored cab 10 further comprises reinforcing structure internal to each V-shaped structure 58 for further mitigating the effects of an IED blast. A horizontal floor 70 is located on each lateral side of the concave wall portion 50. Mounted beneath each floor 70 in its respective V-shaped structure 58 is an undulating reinforcement plate 72 that includes undulations 74 in and out of a horizontal plane of the undulating reinforcement plate 72. For example, the undulating reinforcement plate 72 can include two undulations 74 below the horizontal plane of the undulating reinforcement plate 72 spaced along a length of the undulating reinforcement plate 72. One undulation 74 can correspond to a front seat occupant location and the other undulation 74 can correspond to a back seat occupant location. Each floor 70 can further include a plurality of reinforcement beams 76 on an underside of the floor 70 and spaced along a length of the floor 70. Each reinforcement beam 76 can be oriented generally transverse to the longitudinal axis of the cab 10 and can be generally V-shaped when viewed in longitudinal vertical cross-section. The undulating reinforcement plate 72 and reinforcement beams 76 further reduce upward displacement, velocity, and acceleration of the floors 70, 70 on either lateral side of the cab 10 thus reducing upward displacement, velocity, and acceleration on the occupants of the cab 10 whose feet are supported on those floors 70, 70.

Figure 6:
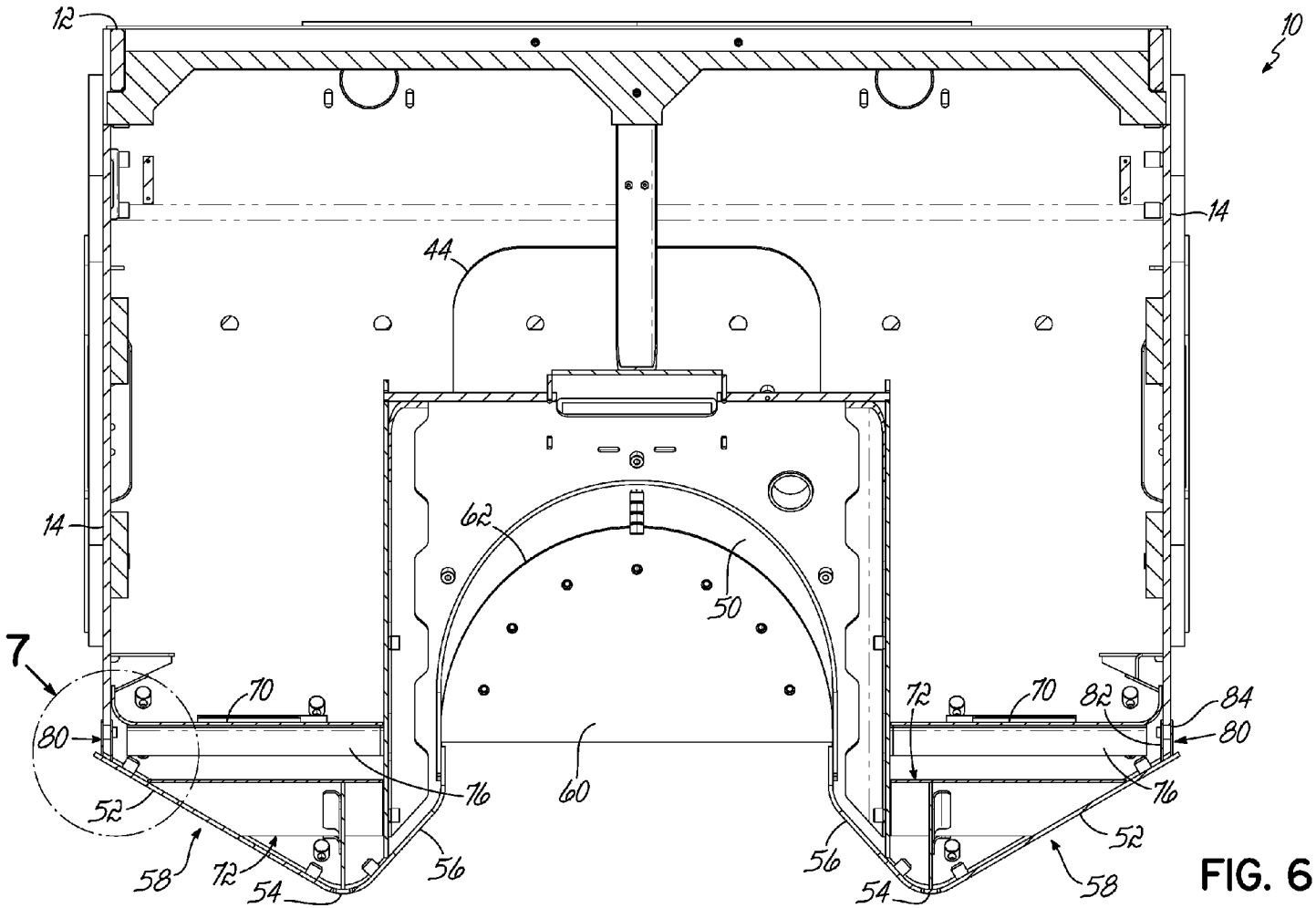
FIG. 6 is a cross-sectional view taken along line 6-6 in FIG. 3.
Figure 7:
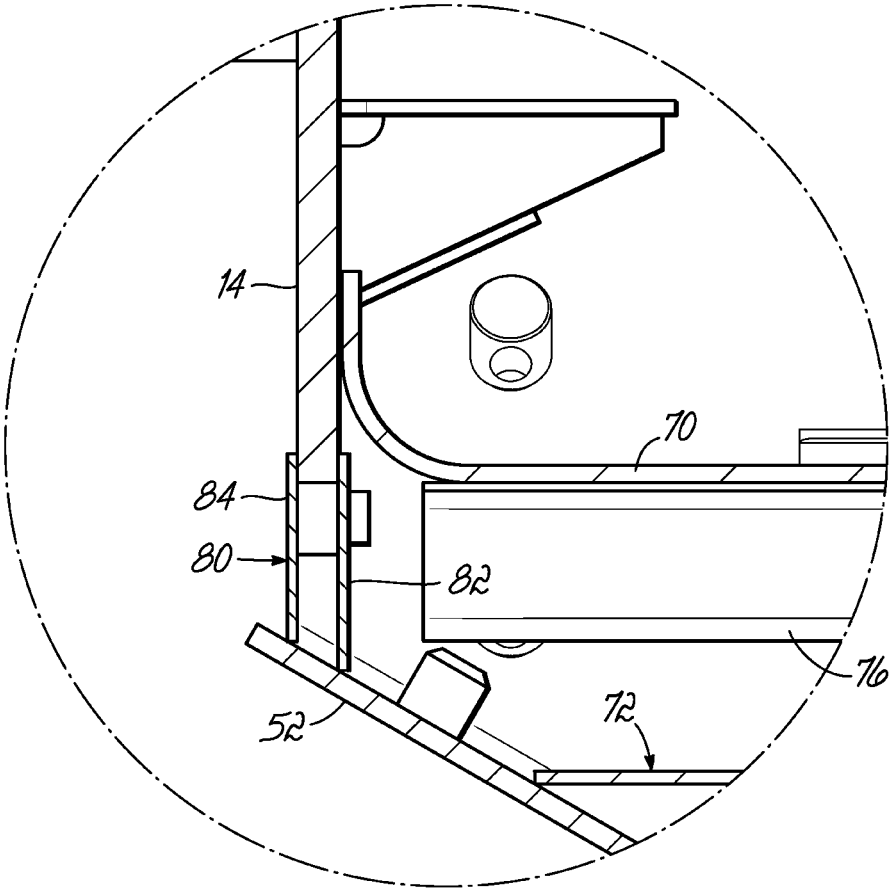
FIG. 7 is an enlarged view of the circled area of FIG. 6.

Referring to FIGS. 6 and 7, armored cab 10 further comprises crushable connection structure 80 connecting each side wall 14 of the cab 10 to a respective one of the pair of opposite laterally disposed wall portions 52, 52 of the bottom wall 20. Each crushable connection structure 80 is located below a respective floor 70 and the connection of that floor 70 to the side wall 14, and is configured to plastically deform by crushing, buckling, etc. in response to a blast to thereby reduce the amount of upward movement transferred from the opposite laterally disposed wall portions 52, 52 of the bottom wall 20 to the cab side walls 14, 14 and from the cab side walls 14, 14 to the floors 70, 70. Each connection structure 80 can comprise a pair of plates 82, 84. One plate 82 of the pair of plates 82, 84 is connected to an inner surface of a respective one of the cab side walls 14, 14 at an upper end of the plate 82. The other plate 84 of the pair of plates 82, 84 is connected to an outer surface of the respective one of the cab side walls 14, 14 at an upper end of the plate 84. The pair of plates 82, 84 are connected at their lower ends to a respective one of the pair of opposite laterally disposed wall portions 52, 52 of the bottom wall 20. The material, height dimension, and thickness dimension of the pair of plates 82, 84 can be selected so as to produce the desired plastic deformation for a given blast load.

Figure 9:
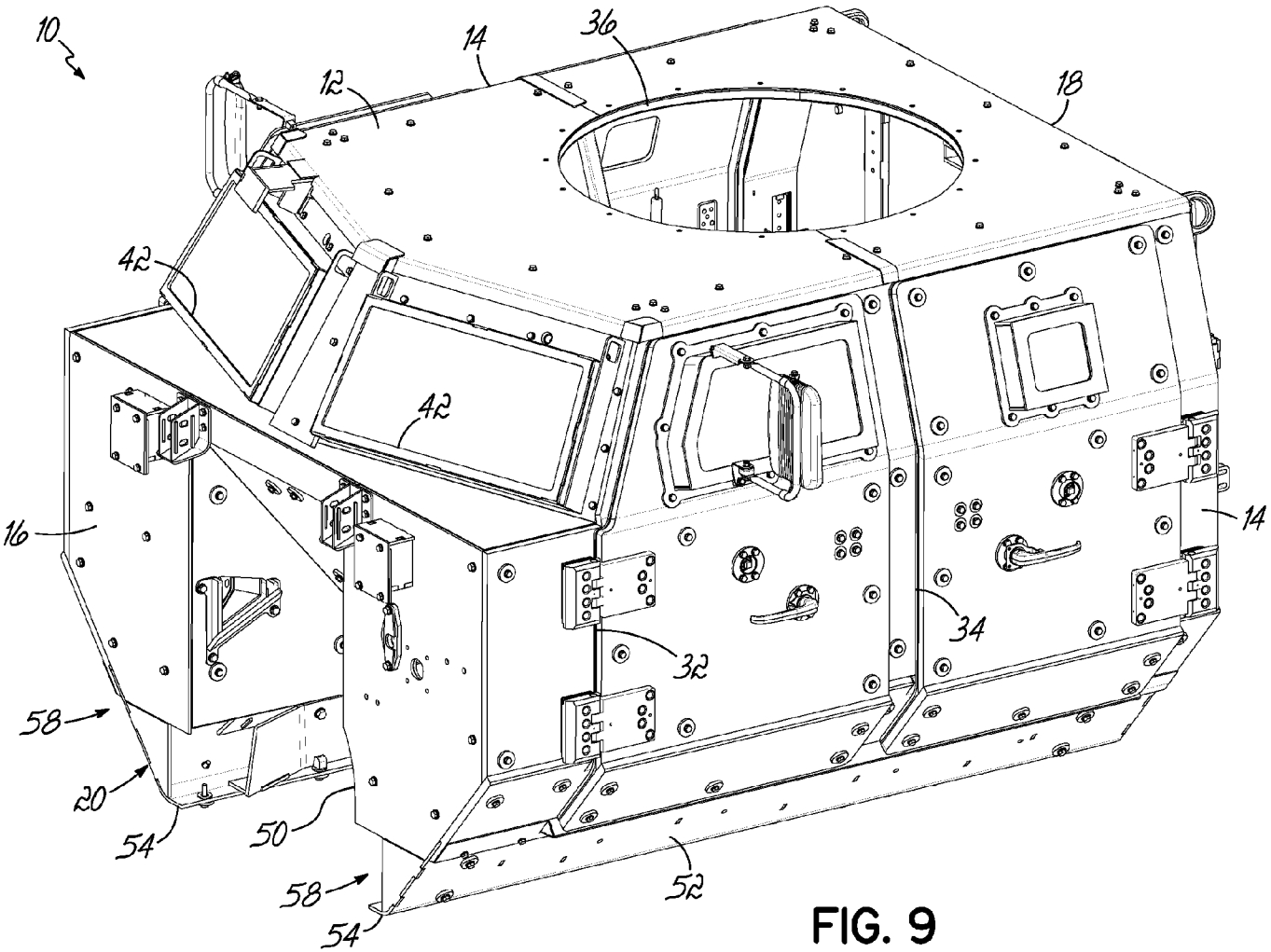
FIG. 9 is a top perspective view of a JLTV armored cab embodying aspects of the present invention.
Figure 10:
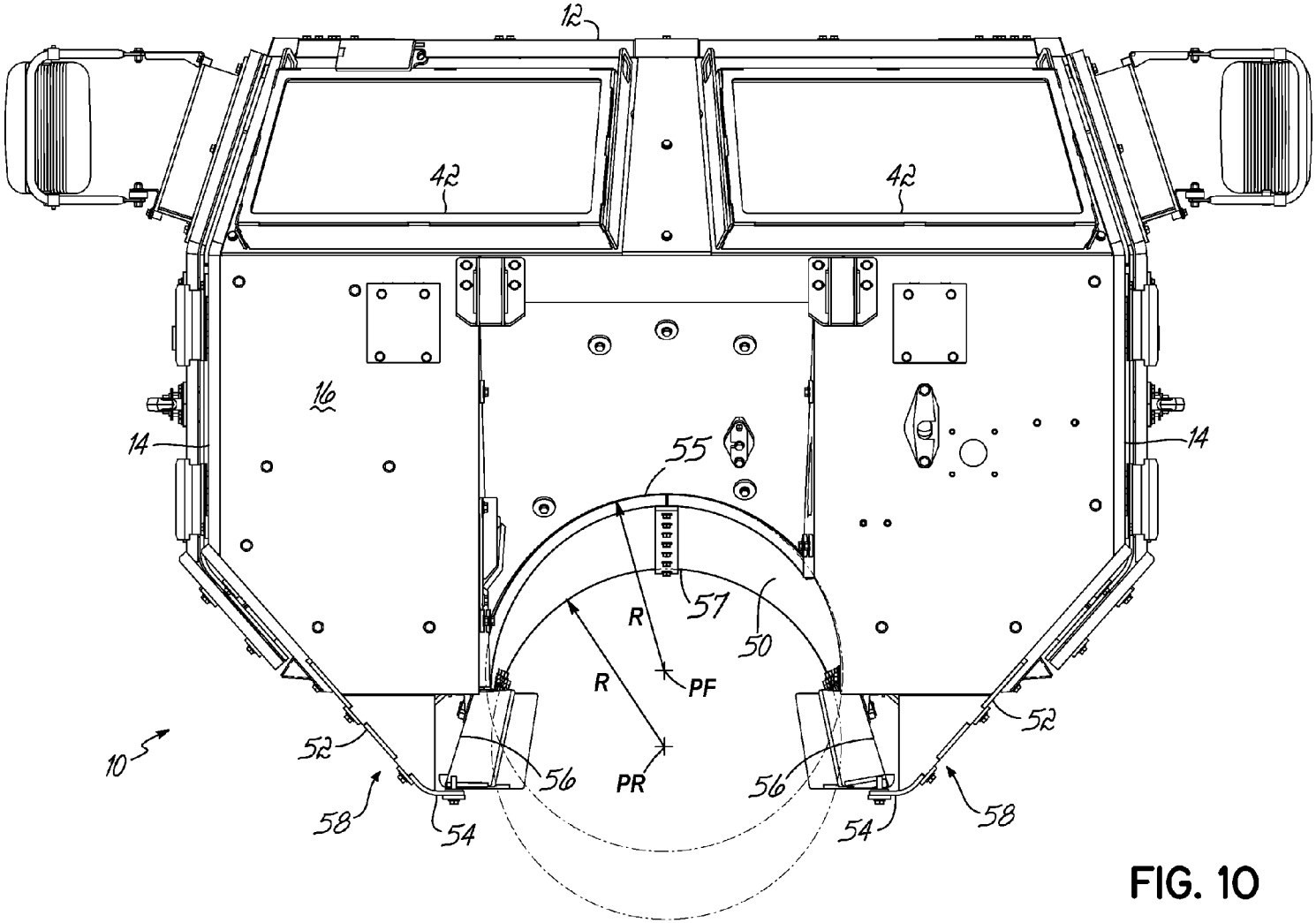
FIG. 10 is a front view of the cab of FIG. 9.
Figure 11:
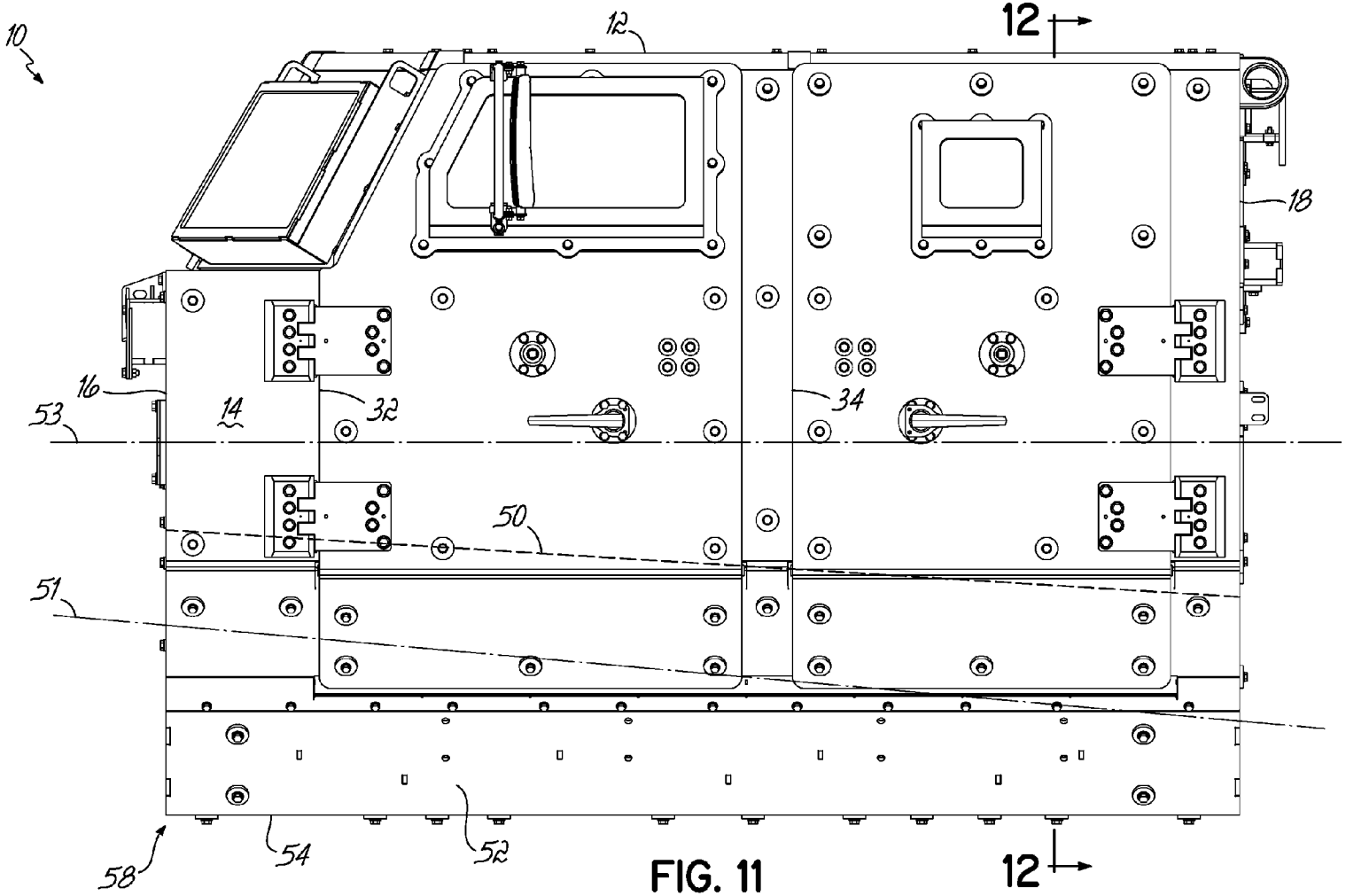
FIG. 11 is a side view of the cab of FIG. 9.

Referring to FIGS. 9-11, and with like numbers representing like elements, another exemplary cab 10 embodying principles of the present invention is illustrated. As illustrated, cab 10 is for the JLTV series of vehicles, although the various inventive aspects embodied in cab 10 can be used for other light tactical vehicles such as the HMMWV MECV, or other tactical vehicles in general.

Figure 12:
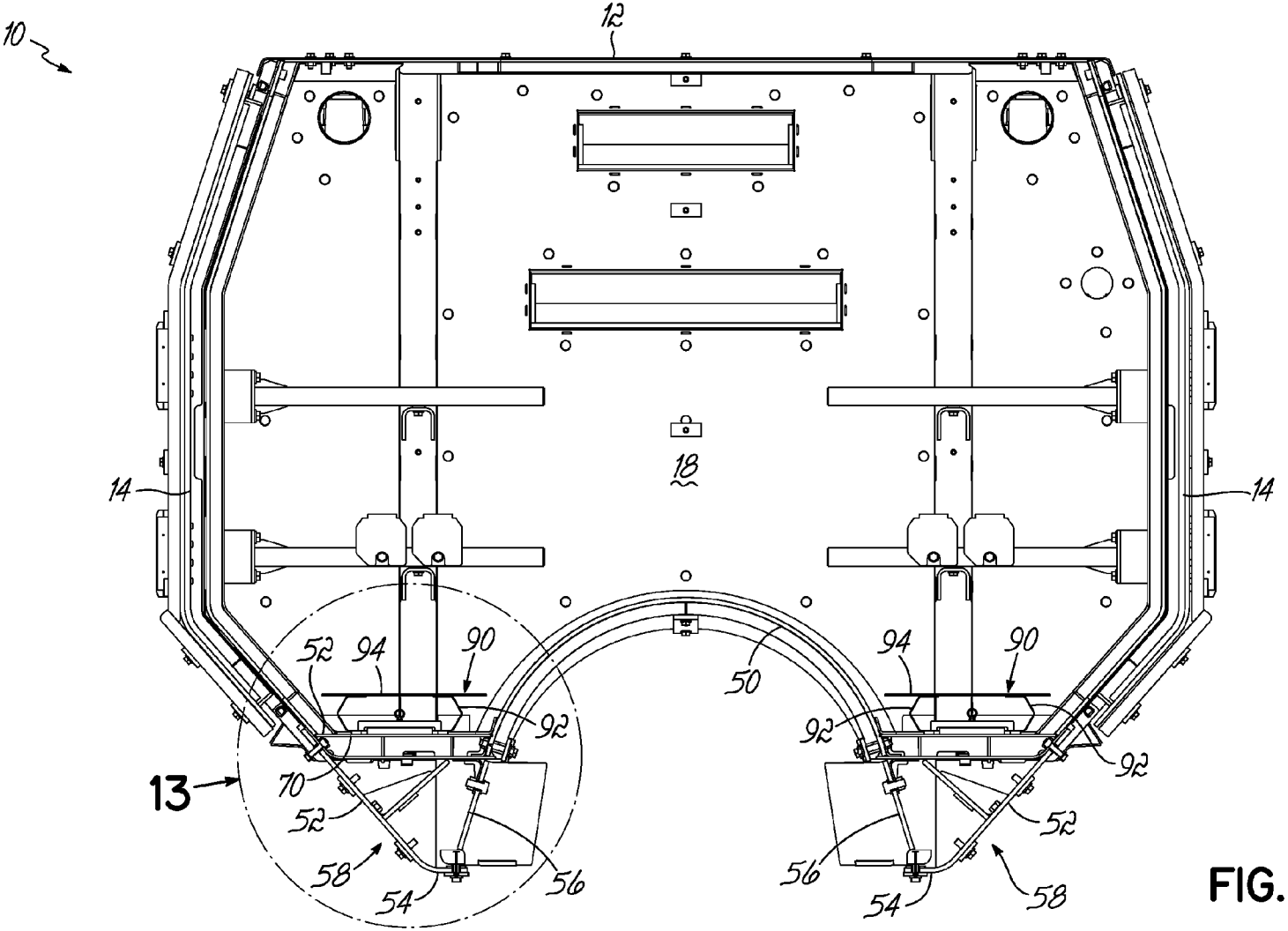
FIG. 12 is a cross-sectional view taken along line 12-12 in FIG. 11.
Figure 13:
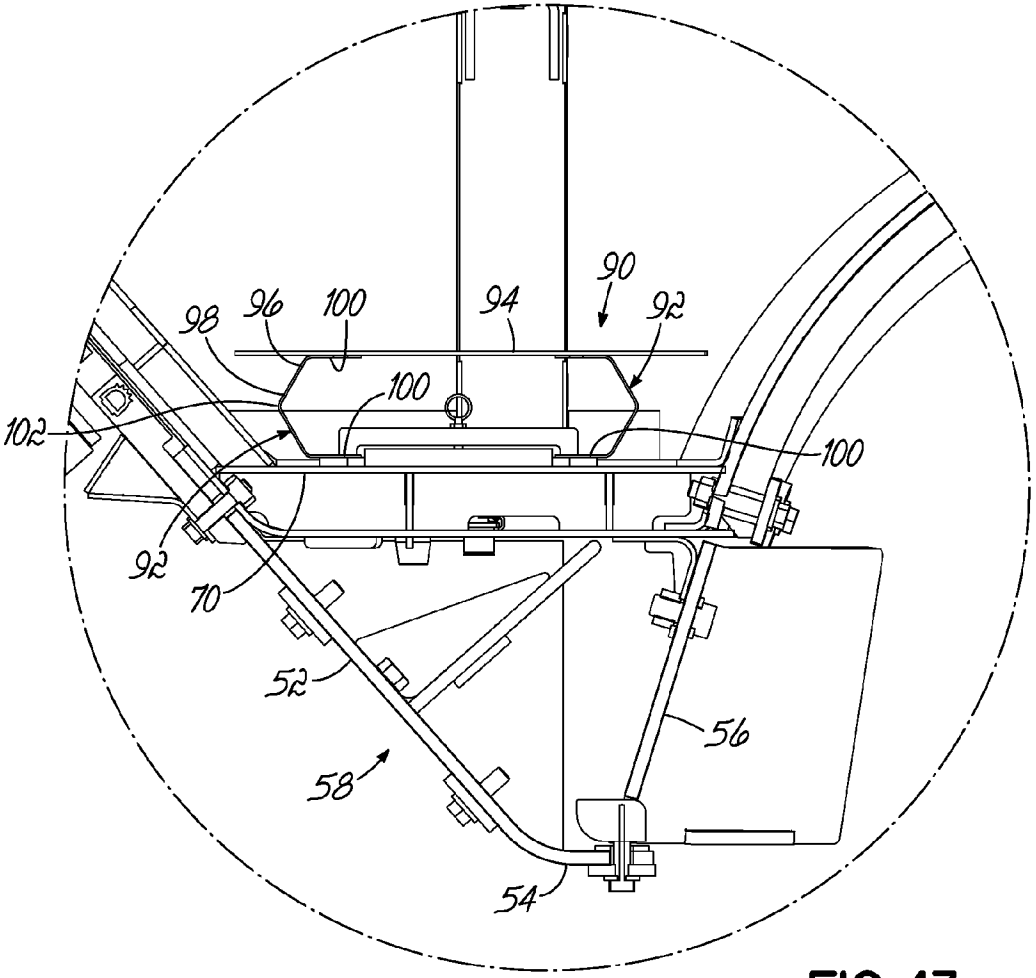
FIG. 13 is an enlarged view of the circled area of FIG. 12.

Referring to FIGS. 12 and 13, the armored cab 10 further comprises an isolation floor 90 on each generally horizontal floor 70 on each lateral side of the concave wall portion 50. Each isolation floor 90 is configured to plastically deform in response to a blast to thereby reduce the amount of upward movement transferred from the generally horizontal floor 70 to an occupant atop the isolation floor 90. More particularly, each isolation floor 70 can comprise a pair of deck supports 92, 92 and a generally rectangular deck 94 supported atop the deck supports 92, 92. Each deck support 92 can comprise a channel section 96 having a center section 98 and opposite end sections 100, 100. One of the end sections 100, 100 is supported on the generally horizontal floor 70 the other of the end sections 100, 100 supports the deck 94. The center section 98 has a longitudinally extending bend line 102 such that the center section 98 is generally V-shaped. As illustrated, each of the channel sections 96, 96 is positioned so as to face inwardly. The material of the channel section 96, height dimension of the center section 98 of the channel section 96, the included angle of the V-shaped center section 98, and the thickness dimension of the channel section 96 can be selected so as to produce the desired plastic deformation for a given blast load.

Figure 14:
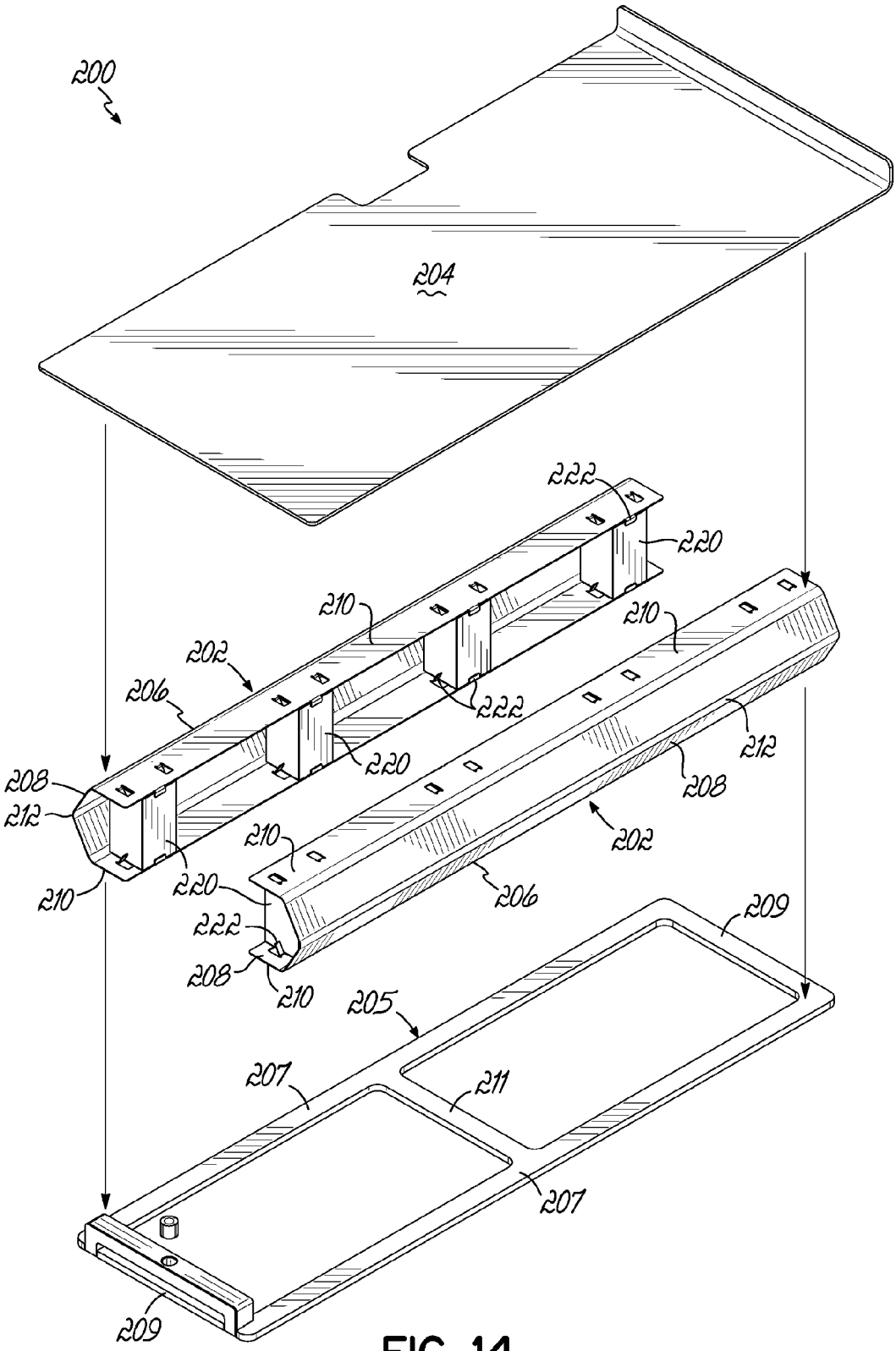
FIG. 14 is an exploded perspective view of another embodiment of the isolation floor shown in FIGS. 12 and 13.
Figure 15:
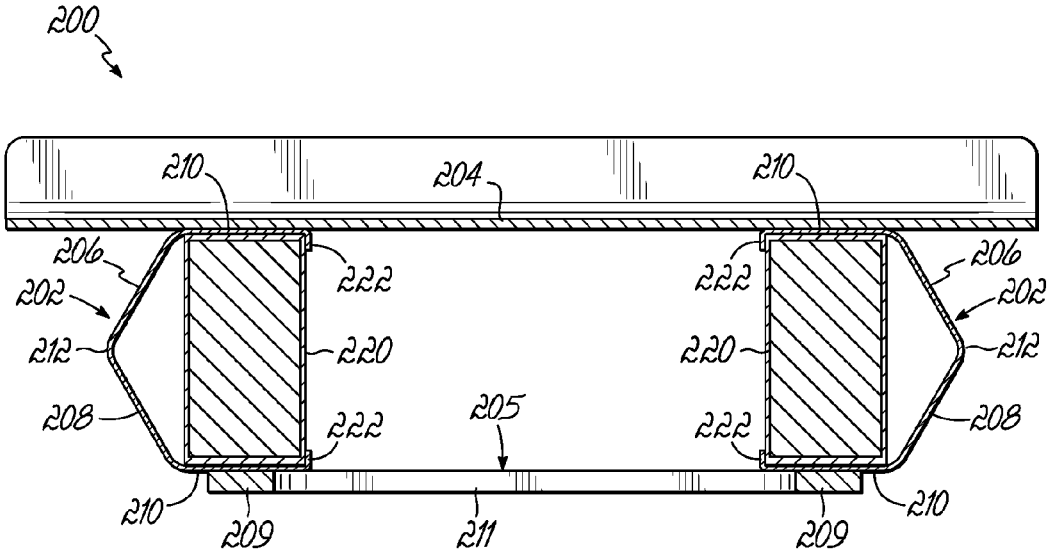
FIG. 15 is a transverse cross-sectional view of the embodiment of the isolation floor shown in FIG. 14.

Referring now to FIGS. 14 and 15, a readily and rapidly replaceable isolation floor module or cartridge 200 is illustrated. The isolation floor module or cartridge 200 is designed to be readily and rapidly removed from a vehicle that has encountered a blast event, and readily and rapidly replaced with a new such isolation floor module or cartridge 200 in order to quickly place the vehicle back into service. The isolation floor module 200 can comprise a pair of deck supports 202, 202, a generally rectangular upper deck 204 supported atop the deck supports 202, 202, and a generally rectangular lower open frame 205 to which the deck supports 202, 202 are mounted. Lower open frame 205 includes longer longitudinally oriented side frame members 207, 207, shorter transversely oriented end frame members 209, 209, and a transversely oriented cross frame member 211. Lower frame 205 can be removably attached to floor 70 described above with fasteners as by bolting or the like.

Each deck support 202 is similar to that described above and can comprise a channel section 206 having a center section 208 and opposite end sections 210, 210. One of the end sections 210, 210 is supported on and mounted to the lower frame 207 and the other of the end sections 210, 210 supports and has mounted thereto the upper deck 204. The channel sections 206, 206 can be secured to the lower frame 207, and the upper deck 204 can be secured to the channel sections 206, 206, by bolting, by welding, or the like. The center section 208 has a longitudinally extending bend line 212 such that the center section 208 is generally V-shaped. As illustrated, each of the channel sections 206, 206 is positioned so as to face inwardly.

Suitable materials and geometries for the components of the isolation floor module 200 are as follows. The upper deck 204 can be about 668 mm by about 312 mm by about 3 mm thick, and fabricated of 6061-T6 aluminum. The lower frame 205 can be about 200 mm by about 677 mm by about 6 mm thick, and fabricated of 6061-T6 aluminum. Each deck support 202 can be about 617 mm long by about 73 mm high by about 60 mm wide with each end section 210 being about 40 mm wide, and fabricated of about 0.8 mm thick 6061-T6 aluminum. Other suitable materials and geometries are of course possible.

To increase the stiffness of the isolation floor module 200 for walking/everyday use, while still retaining energy absorbing properties during high strain rate events, energy absorbing columns 220 are placed between the end sections 210, 210 of each channel section 206 and are approximately evenly spaced along the length of each channel section 206. One type of energy absorbing column 220 which has been found to be acceptable is a pre-crushed 5052 aluminum foil honeycomb block having a cross section of about 38 mm by about 38 mm and a height (after pre-crushing) of about 71 mm and which can withstand about 25 psi of compression before crushing. An aluminum faceplate (not shown) having a thickness of about 0.5 mm can be bonded to the upper surface and to the lower surface of each pre-crushed aluminum honeycomb block with a commercial grade epoxy. Each such pre-crushed aluminum honeycomb block can withstand about 25 psi of compression before crushing about 2 inches to about 4 inches. Such a pre-crushed aluminum honeycomb block is available from Plascore, Inc., 615 N. Fairview Street, Zeeland, Mich. 49464, www.plascore.com. Pre-crushing the aluminum honeycomb blocks has been found to be preferable as a fairly large amount of energy is required to begin crushing, whereas the amount of energy required to continue crushing is substantially less. As illustrated, the blocks 220 can be adhesively secured to the end sections 210, 210 of each channel section 206 as well as located and secured with bent tabs 222 bent out of the plane of each end section 210.

The combination of eight such energy absorbing columns 220 (four per each side) with the deck supports 202 fabricated of the materials and dimensions above yields a structure that requires about 650 lbs to crush the upper deck 204 downwardly by about 2 inches to about 4 inches. About 200 lbs of resistance is attributable to the channel sections 206, 206 and about 450 lbs of resistance is attributable to the eight pre-crushed aluminum blocks 220. Thus, a ninety five percentile weight soldier with gear, weighing about 273 pounds, will not crush or plastically deform the channel sections 206, 206 and the eight pre-crushed aluminum blocks 220 during normal walking on the upper deck 204, assuming the soldier generates about 2 g's during normal walking or about 546 pounds of downward force on the upper deck 204. However, an acceleration of about 2.4 g's will generate a load of about 650 lbs on the upper deck 204 due to the weight of the soldier, and will thus crush the energy absorbing columns and deck supports.

While energy absorbing columns of the pre-crushed aluminum honeycomb block type described above have been found to be suitable, other materials for the energy absorbing columns could also be used. For example, energy absorbing foam such as extruded, thermoplastic, closed-cell foam could be used. One such type of energy absorbing foam is manufactured by Dow Chemical Company, 1250 Harmon Road, Auburn Hills, Mich. 48362, www.dow.com, and is marketed as IMPAXX 300 styrenic thermoplastic or IMPAXX 500 styrenic thermoplastic. Eight cylinders each having a length of about 71 mm, an outer diameter of about 35 mm, and an inner diameter of about 12 mm, fabricated of such foam could be used. As a further example, visco-elastic polymeric materials such as those manufactured by Sorbothane, Inc., 2144 State Route 59, Kent, Ohio 44240, www.sorbothane.com, could also be used.

Empirical testing was performed on a vehicle in the light tactical vehicle class, as defined above, that included the concave bottom wall, the bridging structure, the undulating reinforcement plates, and the crushable connection structure. The vehicle was subjected to a land mine blast of the magnitude typically encountered on today's battle field. A reduction in upward floor velocity of the floor on each lateral side of the concave bottom wall of the vehicle from about 30 meters/second (for a vehicle without the bridging structure, the undulating reinforcement plates, and the crushable connection structure) to about 10 meters/second was experienced. When the isolation floor was added to the vehicle, a further reduction of about 65% in force transmitted to the lower extremities of an occupant was experienced.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. For example, any of the improvements disclosed herein can be used in either or both of the JLTV series of vehicles and the HMMWV MECV series of vehicles, or other light tactical vehicles or tactical vehicles. And, any of the improvements disclosed herein can be used separately or in combination with any of the other improvements disclosed herein. Further, any of the improvements disclosed herein can be used in a tactical vehicle that does not have the described concave bottom wall with V-shaped structures on either lateral side of the concave bottom wall. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. An armored cab comprising:

a top wall, two side walls, a front wall, a back wall, and a bottom wall, said cab having a longitudinal axis, said bottom wall comprising a generally centrally disposed downwardly facing smooth concave wall portion extending substantially an entire length of said cab and generally parallel to said longitudinal axis of said cab and forming a power train tunnel of said cab, and a pair of opposite laterally disposed wall portions extending substantially the entire length of said cab and generally parallel to said longitudinal axis of said cab, each of said opposite laterally disposed wall portions extending downwardly and laterally inwardly and terminating in a lowermost portion of said bottom wall on either lateral side of said concave wall portion, said concave wall portion and said opposite laterally disposed wall portions configured so as to present a substantially reduced surface area of said lowermost portions of said bottom wall in a downwardly facing direction, a generally horizontal floor on each lateral side of said concave wall portion, and an undulating reinforcement plate beneath each said floor including undulations in and out of a horizontal plane of said undulating reinforcement plate spaced along a length of said undulating reinforcement plate.

2. The armored cab of claim 1 wherein each said undulating reinforcement plate includes two undulations below the horizontal plane of said undulating reinforcement plate spaced along the length of said undulating reinforcement plate.

3. The armored cab of claim 2 wherein each said undulation corresponds to a respective one of a front seat occupant location and a back seat occupant location.

4. The armored cab of claim 1 wherein each said floor includes a plurality of reinforcement beams on an underside of said floor and spaced along a length of said floor, each said reinforcement beam of said plurality of reinforcement beams being oriented generally transverse to said longitudinal axis of said cab and being generally V-shaped when viewed in longitudinal vertical cross-section.

5. The armored cab of claim 1 further comprising:

said generally horizontal floor connected to a respective one of said side walls of said cab, and crushable connection structure connecting each said side wall of said cab to a respective one of said pair of opposite laterally disposed wall portions of said bottom wall, each said crushable connection structure located below a respective floor, each said crushable connection structure configured to plastically deform in response to a blast to thereby reduce the amount of upward movement transferred from said opposite laterally disposed wall portions of said bottom wall to said cab side walls and from said cab side walls to said floors.

6. The armored cab of claim 5 wherein each said crushable connection structure comprises a pair of plates, one of said pair of plates connected to an inner surface of a respective one of said cab walls at an upper end of said one plate, the other of said pair of plates connected to an outer surface of the respective one of said cab side walls at an upper end of said other said plate, said pair of plates connected at lower ends of said plates to a respective one of said pair of opposite laterally disposed wall portions of said bottom wall.

7. The armored cab of claim 5 wherein the plastic deformation in response to the blast is a function of a material, a height dimension, and a thickness dimension of said pair of plates.

8. The armored cab of claim 1 further comprising:

an isolation floor on each said generally horizontal floor, each said isolation floor configured to plastically deform in response to a blast to thereby reduce the amount of upward movement transferred from said generally horizontal floor to an occupant atop said isolation floor.

9. The armored cab of claim 8 wherein each said isolation floor comprises:

a pair of deck supports, and a generally rectangular deck having a pair of opposite sides, each of said pair of deck supports supporting a respective one of said sides of said deck, each said deck support comprising a channel section having a center section and opposite end sections, one of said end sections supported on said generally horizontal floor the other of said end sections supporting said deck, said center section having a longitudinally extending bend line such that said center section is generally V-shaped.

10. The armored cab of claim 9 wherein each of said channel sections face inwardly.

11. The armored cab of claim 9 wherein the plastic deformation in response to the blast is a function of a material, a height dimension of said center section, an included angle of said V-shaped center section, and a thickness dimension of said channel section.

12. The armored cab of claim 1 further comprising a generally V-shaped in longitudinal, vertical cross-section bridging structure interconnecting opposite sides of said concave wall portion.

13. The armored cab of claim 8 wherein said isolation floor is a readily replaceable module.

* * * * *